United States Patent [19]

Chen

[11] 4,211,635

[45] Jul. 8, 1980

[54] CATALYTIC CONVERSION OF HYDROCARBONS

[75] Inventor: Nai Y. Chen, Titusville, N.J.

[73] Assignee: Mobil Oil Corporation, New York, N.Y.

[21] Appl. No.: 32,080

[22] Filed: Apr. 23, 1979

[51] Int. Cl.[2] ..... C10G 13/04

[52] U.S. Cl. ..... 208/93; 208/111

[58] Field of Search ..... 208/93, 108, 111

[56] References Cited

U.S. PATENT DOCUMENTS

| | | | |
|---|---|---|---|
| 3,425,810 | 2/1969 | Scott | 208/210 |
| 3,579,435 | 5/1971 | Olenzak et al. | 208/93 |
| 3,723,295 | 3/1973 | Kress | 208/93 |
| 3,755,145 | 8/1973 | Orkin | 208/111 |
| 4,011,154 | 3/1977 | Strangeland et al. | 208/93 |
| 4,137,148 | 1/1979 | Gillespie et al. | 208/111 |

*Primary Examiner*—Herbert Levine
*Attorney, Agent, or Firm*—Charles A. Huggett; Raymond W. Barclay

[57] ABSTRACT

Distillate petroliferous stocks such as neutral lubricating stocks and distillate fuels are hydroprocessed for dewaxing and/or removal of sulfur, nitrogen and metals under hydrogen pressure in a downflow reactor packed with a catalyst suited to the desired conversions in which lighter portions of the charge are introduced to respectively lower levels of the catalyst bed, whereby product withdrawn from the bottom of the reactor is reconstituted distillate of which lighter portions have received milder treatment. In a specific application to catalytic hydrodewaxing of lubricating oil stocks, improvement of Viscosity Index (VI) of dewaxed product results.

10 Claims, 1 Drawing Figure

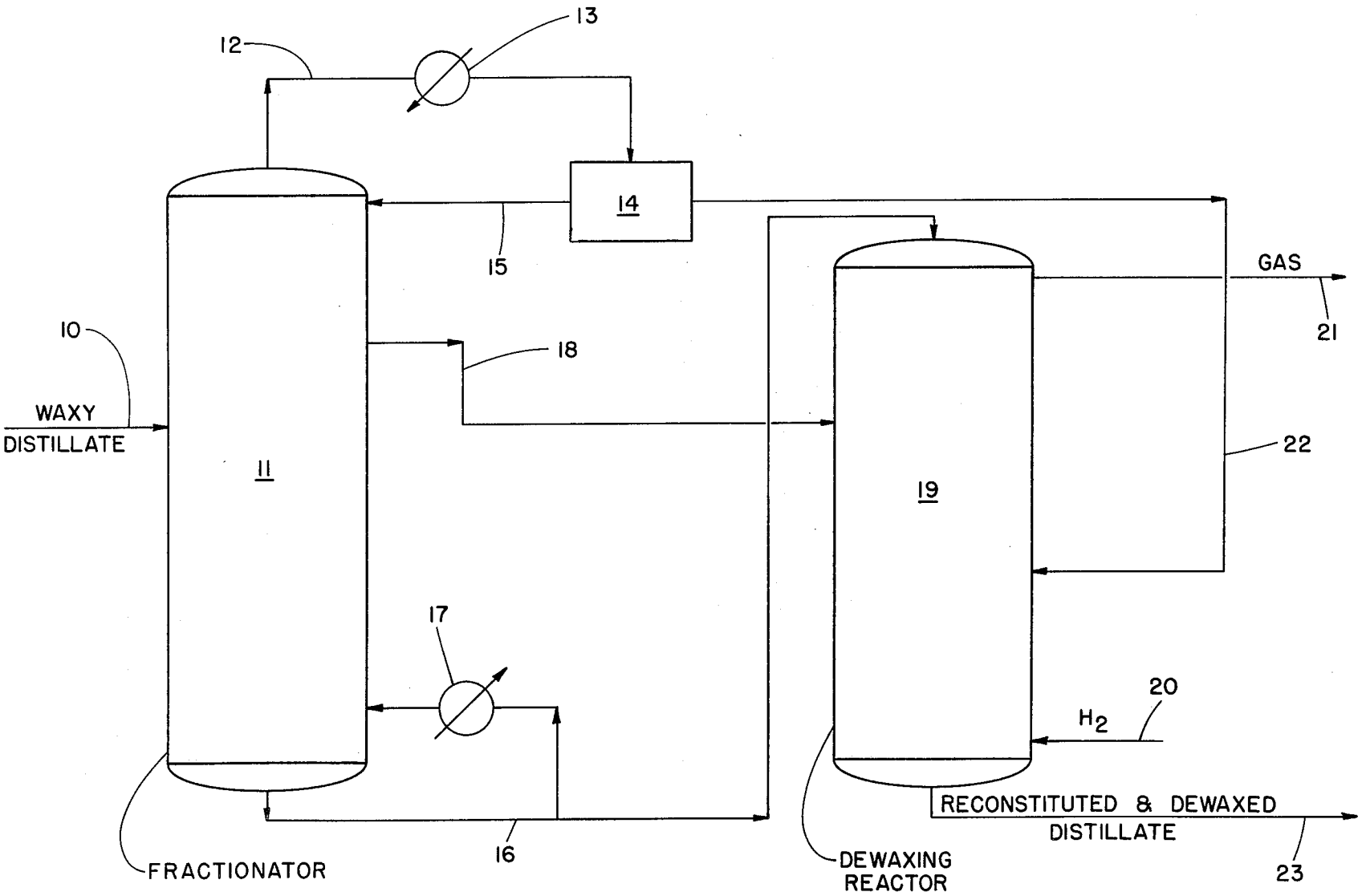
GAS
21
22
23
20
$H_2$
RECONSTITUTED & DEWAXED
DISTILLATE
19
DEWAXING
REACTOR
14
13
18
15
16
17
12
11
FRACTIONATOR
10
WAXY
DISTILLATE

CATALYTIC CONVERSION OF HYDROCARBONS

FIELD OF THE INVENTION

The invention is concerned with reducing wax content of distillate hydrocarbon fractions by conversion of straight or slightly branched paraffin hydrocarbons contained therein. The conversion is accomplished by shape selective dual function catalysts in the presence of hydrogen, a technique aptly designated catalytic hydrodewaxing.

It has long been recognized that long straight chain paraffin hydrocarbons containing upwards of about 18 carbon atoms will crystallize from a solution in petroleum hydrocarbons at substantially lower temperatures than the freezepoint of other hydrocarbons of like boiling point. A fraction separated from a waxy crude oil by distillation will become incapable of flow from a vessel at a temperature (the pour point) such that the wax crystals formed will inhibit such flow. Lubricants and liquid fuels cannot be used in the intended manner at temperatures below the pour point. Difficulties due to poor pumpability and clogging of filters can be encountered at higher temperatures due to suspended wax crystals in the oil.

Dewaxing of lubricating oils has been practiced for many years by chilling the oil, usually in a solvent, and separating the wax crystals, as by filters, centrifuges and the like. A more recent development is catalytic hydrodewaxing in which a mixture of hydrogen and waxy hydrocarbon fraction is contacted at conversion conditions of temperature and pressure with a shape selective porous solid catalyst having acid activity for cracking in combination with a metallic hydrogenation/dehydrogenation catalyst. The porous solid catalyst is characterized by uniform pores which will admit only straight chain or straight and slightly branched chain aliphatic compounds and therefore converts only those compounds so admitted. Mordenite and zeolite ZSM-5 are typical.

In addition to catalytic hydrodewaxing, the invention contemplates conversion of distallate hydrocarbon stocks, particularly those containing sulfur, nitrogen and metal contaminates to provide good yields of such premium products as lube oil neutral base stock, diesel fuel, jet fuel, distillate fuel oil and kerosene. Such premium products are frequently hydroprocessed (hydrofinishing) for chemical stability. In addition, the sulfur content of fractions from many crudes exceeds environmentally acceptable limits. That feature is usually handled by hydrodesulfurization, a catalytic reaction under hydrogen pressure in the presence of a catalyst having hydrogenation/dehydrogenation activity such as cobalt and molydenum oxides or sulfides on a refractory support such as alumina.

Similar considerations apply to fractions obtained by extraction of liquid hydrocarbons from oil shale by heating and to coal liquids such as solvent refined coal (SRC). The invention contemplates treatment of all such materials for dewaxing, generally without major reduction in boiling range.

BACKGROUND OF THE INVENTION

Hydroprocessing of hydrocarbon stocks for various purposes makes use of varied catalysts, the characteristics of which are well understood in the art. Referring more particularly to catalytic hydrodewaxing, that process employs the technique described in U.S. Pat. No. 3,140,322 of providing catalytic sites in a porous crystalline aluminosilicate having uniform pore diameters on the order of molecular dimensions. Thus, conversion is restricted to those molecules which can enter through the uniform pores to contact the catalytic sites at interior surfaces of the zeolite. In one embodiment of that invention, the zeolite catalyst has pores of a dimension to admit long straight chain aliphatic compounds in the nature of petroleum wax. In the acid (protonic) form, these zeolites will crack the wax molecules to lower molecular weight compounds of lower boiling range which will not crystalize at the same pour point as the original wax and which may be removed by distillation, if desired. Among the zeolites proposed for this, mention may be made of mordenite and zeolite ZSM-5.

The preferred zeolites for catalytic hydrodewaxing are those having shape selective properties similar to that of zeolite ZSM-5 as described for that purpose in U.S. Pat. No. Re. 28,398, Chen et al. These techniques are effective to reduce pour points and cloud points of fuels and lubricants.

It is common practice to hydrotreat certain stocks for removal of sulfur, nitrogen and metals. For example, feed for hydrocracking may be first contacted with a hydrotreating catalyst in the presence of hydrogen. The hydrotreater effluent is condensed and separated from unused hydrogen, ammonia, hydrogen sulfide and gaseous hydrocarbons such as methane for recycle to the reactor after scrubbing to remove hydrogen sulfide and ammonia. The condensate is then mixed with a further supply of hydrogen and passed through one or more beds of hydrocracking catalyst to produce products of lower boiling range than the feed. Typically, the hydrocracker is a series of beds in a vertical reactor and the charge is passed downward in concurrent flow with hydrogen. The reactions taking place are exothermic, resulting in a temperature rise in each bed. Temperature is controlled by addition of cold hydrogen between the beds.

It will be seen that the conventional hydrocracker is a multi-stage operation of first stage pretreater and second stage hydrocracker with similar reactions taking place in both stages, but to different relative degrees. In the first stage, the predominant reactions are desulfurization, denitrogenation and demetallation with a lesser degree of cracking. The high pressure separator to provide a recycle hydrogen stream will remove methane but, for the most part, other cracked products will be retained in the feed to the hydrocracker. In the latter stage, the predominant reaction is cracking, applied alike to heavy components and to potential gasoline components derived from cracking in the first stage. Such nitrogen and sulfur compounds as remain after the first stage will be subjected to conversion reactions for removal of these contaminants.

In an effort to reduce the capital cost and operating expense of multi-stage operation, it has been proposed that the first stage (pretreater) effluent be cascaded to the second stage. This results in supply to the hydrocracker of all components of the first stage effluent.

An interesting variant on hydrotreating residual stocks is described in Franz et al. U.S. Pat. No. 3,897,329. The feed is introduced to a region intermediate two beds of cobalt-moly on alumina catalyst. Hydrogen is added with the feed. In addition, hydrogen is supplied to the bottom of the lower bed to pass countercurrent to liquid hydrocarbons flowing down through the bed. In that lower bed, desulfurization takes place at about 850° F. Vaporous products from reaction in the lower bed and those present in the charge pass up into the upper bed together with hydrogen and are there further reacted at the higher temperature of 875° F. The higher temperature in the upper bed will be effective to avoid condensation in that upper bed and return of reflux to the lower bed. As pointed out in the patent, it is not necessary that the two beds be in the same chamber, only that there be conduit means for conveying vapor and hydrogen from the lower bed to the upper bed. In effect, these patentees are providing for more severe reaction conditions (higher temperature and greater hydrogen concentration) applied to the vapor phase charge in the upper bed.

In essence, the Franz et al. patent describes a method of connecting a concurrent vapor phase reactor with a countercurrent trickle bed or mixed phase reactor without interstage separation.

Another form of multiple bed hydrotreating with intermediate supply of charge is found in Pappas et al. U.S. Pat. No. 3,091,586. Contrary to the effects of Franz et al., the Pappas et al. system provides for greatest severity of treatment for the liquid fraction which passes downwardly through three successive catalyst beds. Overcracking of vaporous products formed in any of these beds is avoided by withdrawal of the gas phase from a space above each bed. As a consequence, a fresh supply of hydrogen must be introduced to the bottom of each such bed. A somewhat similar effect is obtained in Scott, Jr. U.S. Pat. No. 3,425,810 by multiple feed and withdrawal conduits in a multi-bed hydrotreater. See also Halik et al. U.S. Pat. No. 3,211,641.

The Pappas et al. patent describes a method of connecting several countercurrent trickle bed reactors with a concurrent vapor phase reactor in the hydrofining of shale oil. Means are provided between reactors to allow the addition of hydrogen and the withdrawal of vaporous products and to conduct liquid flowing from one reactor to the reactor below. It is noted that the vaporous product from one reactor is not fed to the next reactor. Other than the specific mechanical connections, the system is not different from an installation of multi-stage reactors all placed on the ground level.

Scott's hydrotreating apparatus is basically a series of countercurrent flow reactors stacked vertically, with provisions for adding and withdrawing vapor and liquid streams from each reactor.

The fact that the reactors are stacked vertically does not differ in principle from multi-stage reactors on the ground level except that interstage circulation pumps must be provided for the ground level facility.

The Halik et al. patent describes the addition to a multi-stage-reactor system, of a confined saturation zone to dissolve hydrogen in the liquid feedstock and a lift tube which allows the liquid reactant to be recycled from the bottom of the reactor to the top of the reactor with a gaseous reactant stream (hydrogen).

Greater severity of treatment for the liquid portion of a hydrofining charge is provided in Wilson et al. U.S. Pat. No. 3,658,681. That system puts the charge through vacuum distillation to yield a vacuum overhead fraction passed downwardly through a top bed of a reactor to mix with the product of passing the vacuum bottoms upwardly through three beds of catalyst. The combined effluent is withdrawn as a single product stream. Although the Wilson et al. arrangement does afford the advantage of greater severity of treatment for the fraction needing the greater severity, it achieves that result by mixing of fractions having properties of different desired products, involving a pretreatment vacuum distillation to prepare those products and a post-treatment distillation to again separate distillate and residual fuels.

SUMMARY OF THE INVENTION

According to the present invention, a waxy distillate is fractionally distilled to provide two or more fractions of differing boiling range. Those fractions are introduced as liquid to different levels of a downflow trickle reactor containing hydrodewaxing catalyst countercurrent to a stream of hydrogen introduced at the bottom of the bed. The highest boiling ("heaviest") fraction of the waxy distillate is introduced at the top of the bed to traverse the full length thereof, with progressively lighter fractions being introduced at progressively lower levels to traverse progressively shorter paths. The distillate fraction is reconstituted at the bottom of the reactor in dewaxed condition.

Application of the new technique is found to overcome a disadvantage recently discovered in catalytic hydrodewaxing. Examination of the properties of fractions of lubricating stocks from catalytic hydrodewaxing has shown that the lower boiling portions of the stock have low viscosity index. This contrasts with solvent dewaxing which preserves the VI values throughout the boiling range of the dewaxed oil. This effect of catalytic hydrodewaxing is overcome by operating in the manner of this invention whereby the lighter portions of the charge are subjected to milder conversion conditions conducive to retention of high VI across the full boiling range.

As will be recognized, catalytic dewaxing of fuel fractions can also be practiced in the same manner. In that case the process can include hydrotreating for removal of sulfur, nitrogen, metals and the like through packing in part of the column with a suitable hydrotreating catalyst.

BRIEF DESCRIPTION OF THE DRAWINGS

The objects and advantages will be further understood from the description of specific embodiments below when considered in connection with the annexed drawings wherein the single FIGURE is a diagrammatic view in elevation of apparatus for practicing an embodiment of the invention.

DESCRIPTION OF SPECIFIC EMBODIMENTS

Referring now to the single FIGURE of the annexed drawing, the invention may be conducted in a train comprising a fractionator to prepare two or more fractions of the charge, followed by a downflow dewaxing reactor to which the several fractions are introduced at different levels. In the embodiment illustrated, a waxy distillate is supplied by charge line 10 to fractionating column 11. An overhead vapor fraction is withdrawn from the top of column 11 by vapor line 12, condensed in heat exchanger 13 and passed to accumulator 14 from which a portion of the condensate is returned by line 15 as reflux to the top of column 11.

Bottoms from column 11 are withdrawn by line 16, a portion of which may be heated in reboiler 17 for return to the lower portion of column 11. The fractionator may be operated to provide one or more side streams of boiling range intermediate the high boiling bottoms in line 16 and the low boiling overhead in line 12. One such side stream is shown as withdrawn from column 11 by line 18.

The bottoms fraction in line 16 is introduced to the top of hydrodewaxing reactor 19 to flow downwardly through a bed of dewaxing catalyst to be presently described. Gaseous hydrogen is introduced by line 20 to the bottom of reactor 19 and flows upwardly through the catalyst bed to be withdrawn at exhaust line 21 in admixture with light hydrocarbons resulting from catalytic hydroconversion of wax molecules in the charge.

Overhead of column 11 is withdrawn from accumulator 14 and passed by line 22 into reactor 19 at a point below that at which bottoms from fractionator 11 are introduced to reactor 19. The overhead fraction so introduced mixes with the partially reacted bottoms fraction to traverse the remaining length of the catalyst bed and thus undergo a milder catalytic conversion than that applied to the bottoms fraction. In like fashion, one or more intermediate fractions from column 11 may be introduced to reactor 19 intermediate the feed points for overhead and bottoms fractions. One such intermediate stream is shown to be so supplied by line 18. It will be understood that, in the event more than one such intermediate stream is supplied, each will be introduced to reactor 19 intermediate the feed points for the next heavier and next lighter fractions.

The dewaxed liquid stream drawn from the bottom of reactor 19 by line 23 is the reconstituted distillate charge for the process suitably dewaxed by subjecting each of the several fractions thereof to a conversion severity suited to the respective properties of each fraction.

The reactions taking place in reactor 19 are exothermic, tending to raise the temperature in the catalyst bed. The invention provides means to control temperature within the catalyst bed by controlling temperatures of the several streams of hydrocarbon fractions introduced to different levels in the bed. Heat exchangers, not shown, may be provided in lines 16, 18 and 22 for that purpose to maintain the reaction within the temperature limits known for charge and catalyst in any specific application, usually between about 500° F. and about 700° F.

Charge stocks for the process may be any of the distillate fuels and lubricants which require dewaxing to meet product specifications. In general, residual stocks cannot be fractionated without thermal cracking and are therefore unsuited to processing by the present technique, although some atmospheric resids may be so processed if fractionated under vacuum. Vacuum fractionation may also be applied to vacuum tower distillates. However, residual stocks may be included in the charge for the present operation by adding them, with or without vacuum distillation, to one of the charge streams for the reactor of this invention. For example, when the process is used in refining of a lube oil distillate, a propane deasphalted residual fraction may be added to one of the streams from fractionation 11, preferably to the bottoms fraction, depending on severity of the treatment desired for the residual fraction. The residual stock may be so added before or after solvent refining such as furfural extraction. The combined product, dewaxed reconstituted distillate plus dewaxed residual stock may be used as such or may be further fractionated to yield a variety of lube oil blending stocks.

The invention finds particular utility in processing of lubricating fractions since the light ends of such stocks have now been found to suffer degradation of Viscosity Index when the full distillate lube stock is subjected to hydrodewaxing.

Lube feed stocks may be subjected to treatment according to this invention before or after other refining steps such as furfural extraction to improve viscosity index and the like. Since the present dewaxing technique is much less costly than solvent dewaxing, it may be applied to the raw lube distillate before solvent refining. It is also applicable to raffinates from solvent refining in the same order of steps as practiced with solvent dewaxing. Thus the invention contemplates that either the virgin distillate or the furfural raffinate be further fractionated to two or more fractions, for example a 5-35/95-65 split or a 10/25/65 split, and each fraction processed at different reaction conditions.

The preferred catalysts for hydrodewaxing are those zeolites having a constraint index within the approximate range of 1 to 12. These zeolites retain a degree of crystallinity for long periods in spite of the presence of steam at high temperature which induces irreversible collapse of the framework of other zeolites, e.g. of the X and A type. Furthermore, carbonaceous deposits when formed, may be removed by burning at higher than usual temperatures to restore activity. In many environments the zeolites of this class exhibit very low coke forming capability, conducive to very long times on stream between burning regenerations.

An important characteristic of the crystal structure of this class of zeolites is that it provides constrained access to, and egress from the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination a silica to alumina mole ratio of at least about 12; and a structure providing constrained access to the crystalline free space.

The zeolite will have a silica/alumina ratio greater than 12. The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Such zeolites, after activation, acquire an intracrystalline sorption capacity for normal hexane which is greater than that for water, i.e. they exhibit "hydrophobic" properties. It is believed that this hydrophobic character is advantageous in the present invention.

The type of zeolites described freely sorb normal hexane and have a pore dimension greater than about 5 Angstroms. In addition, the structure must provide constrained access to large molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although, in some instances, excessive puckering or pore blockage may render these zeolites ineffective. Twelve-membered rings do not generally appear to offer sufficient constraint to produce the advantageous conversions, although puckered structures exist such as TMA offretite which is a known effective zeolite. Also, structures can be conceived, due to pore blockage or other cause, that may be operative.

Rather than attempt to judge from crystal structure whether or not a zeolite possesses the necessary constrained access, a simple determination of the "constraint index" may be made by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° F. and 950° F. to give an overall conversion between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methyl pentane remaining})}$$

The constraint index approximates the ratio of the cracking rate constants for the two hydrocarbons. Zeolites suitable for the present invention are those having a constraint index in the approximate range of 1 to 12. Constraint Index (CI) values for some typical zeolites are:

| ZEOLITE | C.I. |
|---|---|
| ZSM-5 | 8.3 |
| ZSM-11 | 8.7 |
| ZSM-12 | 2 |
| ZSM-38 | 2 |
| ZSM-35 | 4.5 |
| TMA Offretite | 3.7 |
| Beta | 0.6 |
| ZSM-14 | 0.5 |
| H-Zeolon | 0.4 |
| REY | 0.4 |
| Amorphous Silica-Alumina | 0.6 |
| Erionite | 38 |

It is to be realized that the above constraint index value typically characterize the specified zeolites but that such are the cumulative result of several variables used in determination and calculation thereof. Thus, for a given zeolite depending on the temperatures employed within the aforenoted range of 550° F. to 950° F., with accompanying conversion between 10% and 60%, the constraint index may vary within the indicated approximate range of 1 to 12. Likewise, other variables such as the crystal size of the zeolite, the presence of possible occluded contaminants and binders intimately combined with the zeolite may affect the constraint index. It will accordingly be understood by those skilled in the art that the constraint index, as utilized herein, while affording a highly useful means for characterizing the zeolites of interest is approximate, taking into consideration the manner of its determination, with probability, in some instances, of compounding variables extremes.

While the above experimental procedure will enable one to achieve the desired overall conversion of 10 to 60% for most catalyst samples and represents preferred conditions, it may occasionally be necessary to use somewhat more severe conditions for samples of very low activity, such as those having a very high silica to alumina ratio. In those instances, a temperature of up to about 1000° F. and a liquid hourly space velocity of less than one, such as 0.1 or less, can be employed in order to achieve a minimum total conversion of about 10%.

The class of zeolites defined herein is exemplified by ZSM-5, ZSM-11, ZSM-12, ZSM-35, ZSM-38 and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

The specific zeolites described, when prepared in the presence of organic cations, are catalytically inactive, possibly because the intracrystalline free space is occupied by organic cations from the forming solution. They may be activated by heating in an inert atmosphere at 1000° F. for one hour, for example, followed by base exchange with ammonium salts followed by calcination at 1000° F. in air. The presence of organic cations in the forming solution may not be absolutely essential to the formation of this type zeolite; however, the presence of these cations does appear to favor the formation of this special type of zeolite. More generally it is desirable to activate this type catalyst by base exchange with ammonium salts followed by calcination in air or about 1000° F. for from about 15 minutes to about 24 hours.

Natural zeolites may sometimes be converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminosilicate are ZSM-5, ZSM-11, ZSM-12, ZSM-35, and ZSM-38, with ZSM-5 particularly preferred.

In a preferred aspect of this invention, the zeolites hereof are selected as those having a crystal framework density, in the dry hydrogen form, of not substantially below about 1.6 grams per cubic centimeter. It has been found that zeolites which satisfy all three of these criteria are most desired. Therefore, the preferred zeolites of this invention are those having a constraint index as defined above of about 1 to about 12, a silica to alumina ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967", published by the Society of Chemical Industry, London, 1968. When the crystal structure is unknown, the crystal framework density may be determined by classical pykometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, is important as the locus of catalytic activity.

Crystal framework densities of some typical zeolites are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dichiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable ions of Groups IB to VIII of the Periodic Table, including, by way of example, nickel, copper, zinc, palladium, calcium or rare earth metals.

In practicing the desired conversion process, it may be desirable to incorporate the above-described crystalline aluminosilicate zeolite in another material resistant to the temperature and other conditions employed in the process. Such matrix materials include synthetic or naturally occurring substances as well as inorganic materials such as clays, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix may vary widely with the zeolite content ranging from between about 1 to about 99 percent by weight and more usually in the range of about 5 to about 80 percent by weight of the composite.

The invention is based on the recent discovery that the quality of hydrodewaxed lube basestocks obtained in a conventional downflow fixed bed reactor varies significantly within its boiling range. For example, a hydrodewaxed heavy neutral product of 39° F. pour point has a viscosity index of 92.9, the lowest boiling 5 vol.% of the product has a pour point of 9° F. and a viscosity index of 73. Solvent dewaxed product of the same feedstock has a nearly uniform pour point over the entire boiling range. Thus it appears that the prior catalytic dewaxing process overcracks the lighter boiling fraction and produces products of low viscosity indices. The solution of this problem here described is to distill the feedstock into many boiling range fractions and catalytically process each fraction at a different severity. Thus, in a downflow fixed bed reactor, the different boiling range fractions are introduced to the reactor at different locations so that the residence time of each fraction in the reactor is optimally controlled to give the desired product.

An alternative solution is described in copending application Ser. No. 922,915, filed July 10, 1978, wherein the charge stock is introduced to a mid-point in a column of catalyst operated after the fashion of a distillation column. A fractionation step and the catalytic step are thus integrated into a single operation, and advantage is taken of the variation in temperature of a distillation column as a process parameter such that the lighter fraction would be processed at a lower temperature than the heavier fraction. Thus, a continuous change in reaction severity as a function of the boiling point of the reactant is made possible by that arrangement.

It is also contemplated that a variety of catalysts similar to ZSM-5 may be used in various parts of the reactor. For example, large crystal ZSM-5 or ZSM-23 may be preferred near the bottom of the reactor where the lower boiling fraction would be processed along with the higher boiling fraction; and the microcrystalline ZSM-5 or ZSM-11 may be preferred near the top of the reactor where the high boiling fraction would be the sole reactant.

Conditions in the hydrodewaxing reactor will be generally those described in U.S. Pat. No. Re. 28,389, the entire contents of which are hereby incorporated by reference. The pressure will be between about 100 and 3000 psig, preferably from 200 to 700 psig. Liquid hourly space velocity is much higher in the lower portion of the reactor than in the top section for reasons stated above. That space velocity for the lower section will be generally between about 0.1 and 10 volumes of liquid feed per volume of catalyst per hour, preferably 0.5 to 4. Hydrogen is supplied at a ratio of 1 to 20 moles of hydrogen per mole of total hydrocarbon change, preferably a mole ratio of 4 to 12 $H_2$/HC.

The catalysts employed in this invention are constituted by a zeolite as described above in intimate combination with a hydrogenating component such as tungsten, vanadium, molybdenum, rhenium, nickel, cobalt, chromium, manganese, or a noble metal such as platinum or palladium. Such component can be exchange into the composition, impregnated therein or physically intimately admixed therewith. Such component can be impregnated in or onto zeolite such as, for example, by, in the case of platinum, treating the zeolite with a platinum metal-containing ion. Thus, suitable platinum compounds include chloroplatinic acid, platinous chloride and various compounds containing the platinum ammine complex.

The compounds of the useful platinum or other metals can be divided into compounds in which the metal is present in the cation of the compound and compounds in which it is present in the anion of the compound. Both types of compounds which contain the metal in the ionic state can be used. A solution in which platinum metals are in the form of a cation or cationic complex, e.g., $Pt(NH_3)_4Cl_2$ is particularly useful.

In a specific example, a heavy neutral waxy raffinate with a pour point of 115° F. is fractionated to an overhead of 10% and a bottom fraction of 90%. Their pour points are 80° F. and 120° F. respectively. To hydrodewax the fractions to a 20° F. pour point product in separate reactors, the overhead fraction requires about 20° F. lower section temperature than the bottom fraction. According to the invention, the fractions are processed in a single reactor, by feeding the bottom fraction to the top of the reactor, and the overhead fraction to near the mid section of the reactor such that the residence time of the bottom fraction is nearly twice as long as that of the overhead fraction.

While the example deals with waxy raffinate, it may be more advantageous commercially to fractionate and dewax the virgin distillates before the aromatics extraction step (such as furfural extraction). The catalytic dewaxing step may also be followed by a lube hydrocracking process which eliminates the aromatics extraction step.

Viscosity index is customarily a required specification of lube oil basestocks. The invention provides an improved process which produces lubes fully compatible with solvent dewaxed products at a significantly lower cost.

I claim:

1. A process for improved shape selective catalytic hydrodewaxing of distillate lubricating oil stock which comprises fractionally distilling said stock to provide at least two fractions thereof boiling at different temperature ranges, introducing the highest boiling said fraction to the upper portion of a vertical column of a zeolite having a silica/alumina ratio above 12 and a constraint index between about 1 and about 12 maintained at hydrodewaxing conditions to flow downwardly therethrough, introducing hydrogen to the lower portion of said column for flow upwardly in said column, introducing a lower boiling said fraction to said column at a point intermediate the said introduction of said highest boiling fraction and said introduction of hydrogen to flow in admixture with said highest boiling fraction downwardly as liquid countercurrent to said hydrogen at conversion conditions resulting in shape selective dewaxing conversion of said highest boiling fraction at higher level of severity, and withdrawing from the bottom of said column reconstituted dewaxed distillate lubricating oil stock of improved viscosity index.

2. A process according to claim 1 wherein said stock is a distillate lubricating oil stock.

3. A process according to claim 1 wherein said zeolite is associated with a metal hydrogenation catalyst.

4. A process according to claim 1 wherein said lowest boiling fraction constitutes about 5 to 35 percent of said distillate stock.

5. A process according to claim 1 wherein the hydrodewaxing catalyst in said upper portion of said vertical column is different from the hydrodewaxing catalyst near the bottom of said vertical column.

6. A process according to claim 5 wherein the hydrodewaxing catalyst in said upper portion of said vertical column is microcrystalline ZSM-5 or ZSM-11 and the hydrodewaxing catalyst near the bottom of said vertical column is large crystal ZSM-5 or ZSM-23.

7. A process according to claim 1 wherein said distillate oil stock has been extracted with a selective solvent before introduction of fractions thereof to said vertical column.

8. A process according to claim 1 wherein said reconstituted dewaxed distillate stock is extracted with a selective solvent.

9. A process according to claim 1 wherein said reconstituted dewaxed distillate stock is hydrocracked.

10. A process according to claim 1 wherein a deasphalted residual stock is added to one of said fractions introduced to said column.

* * * * *

UNITED STATES PATENT AND TRADEMARK OFFICE

CERTIFICATE OF CORRECTION

PATENT NO. : 4,211,635

DATED : July 8, 1980

INVENTOR(S) : Nai Yuen Chen

It is certified that error appears in the above—identified patent and that said Letters Patent is hereby corrected as shown below:

Column 11, line 13 "exchange" should read -- exchanged --.

Column 11, line 36, "section" should read -- reaction --.

Signed and Sealed this

*Eighteenth* Day of *November 198(*

[SEAL]

*Attest:*

SIDNEY A. DIAMOND

*Attesting Officer*

*Commissioner of Patents and Trademarl*